US005862864A

United States Patent [19]

Whiteford

[11] Patent Number: 5,862,864

[45] **Date of Patent: *Jan. 26, 1999**

[54] WELL SAFETY SYSTEM

[75] Inventor: Drummond Wilkinson Whiteford, Milltimber, Great Britain

[73] Assignee: Petroleum Engineering Services Limited, Dyce, Great Britain

[ * ] Notice: This patent issued on a continued prosecution application filed under 37 CFR 1.53(d), and is subject to the twenty year patent term provisions of 35 U.S.C. 154(a)(2).

[21] Appl. No.: 595,496

[22] Filed: Feb. 1, 1996

[30] Foreign Application Priority Data

Feb. 3, 1995 [GB] United Kingdom ..... 9502154

[51] Int. Cl.[6] ..... F21B 34/10

[52] U.S. Cl. ..... 166/321; 166/332.8

[58] Field of Search ..... 166/321, 324, 166/332.8, 386

[56] References Cited

U.S. PATENT DOCUMENTS

| | | | |
|---|---|---|---|
| 4,415,036 | 11/1983 | Carmody et al. | 166/324 |
| 4,427,071 | 1/1984 | Carmody | 166/332 |
| 4,601,341 | 7/1986 | Pringle et al. | 166/321 |
| 4,629,002 | 12/1986 | Pringle | 166/324 |
| 5,058,682 | 10/1991 | Pringle | 166/324 |

FOREIGN PATENT DOCUMENTS

| | | |
|---|---|---|
| 1 499 050 | 1/1978 | United Kingdom . |
| 2 018 332 | 10/1979 | United Kingdom . |
| 2 098 261 | 11/1982 | United Kingdom . |
| 2 165 871 | 4/1986 | United Kingdom . |
| 2 199 604 | 7/1988 | United Kingdom . |

*Primary Examiner*—David J. Bagnell
*Attorney, Agent, or Firm*—Thelen Reid & Priest LLP

[57] ABSTRACT

A subsurface safety valve includes a one piece pressure housing having a flow passage provided therethrough and a recess formed in a side wall of the flow passage. A flapper member having first and second, respectively open and closed positions, is mounted to the housing in the recess. A control mechanism controls movement of the flapper member between its first and second positions. The control mechanism may include at least one piston substantially longitudinally aligned with flow passage wall, the at least one piston being positioned in longitudinal relation to a portion of a surface of the wall, the surface of the wall being provided with a longitudinal groove and the at least one piston being provided with a protrusion which is received within the longitudinal groove.

14 Claims, 12 Drawing Sheets

WELL SAFETY SYSTEM

TECHNICAL FIELD

This invention relates to a well valve, and in particular, though not exclusively, to a well safety valve for use in a production tubing string of a petroleum/gas producing well, whether or not the well is located on land or at sea.

BACKGROUND ART

Subsurface well safety valves are known. Tubing mounted flapper type safety valves are traditionally assembled by fitting a flapper, hinge pin, return spring and hinge pin retainer into a seat. The assembly is then installed into a pressure housing. This type of flapper safety valve has disadvantageous effect on the maximum internal bore and minimum outer diameter of the valve which can be achieved. This is a very important consideration for the oil industry since, in general, it is desired to maximise production, (ie maximise internal bore size) but achieve this inside as small a casing line as possible (thereby saving cost on casing).

Many valve manufacturers have sought to overcome the aforementioned disadvantage by designing curved flapper valves, which are again installed within a pressure housing as hereinbefore described. However, despite extensive efforts by many manufacturers, curved flapper valves have been found to suffer from a number of problems. For example, increased manufacturing cost vis-a-vis traditional flapper valves, and as yet unexplained failure phenomenon.

It is an object of the present invention to obviate or mitigate the aforementioned problems/disadvantages in the prior art.

SUMMARY OF THE INVENTION

According to a first aspect, the present invention provides a well valve comprising a house having a flow passage provided therethrough, a flapper member and means for controllably moving the flapper member between first and second, respectively open and closed positions, wherein the flapper member is mounted upon a side wall of the housing.

The valve may be of the so-called non-equalizing type, wherein some external means of balancing pressure across the closed flapper is provided prior to opening of the valve.

Alternatively the valve may be of the so-called self-equalising type, wherein pressure across the closed flapper is equalised automatically during the openning sequence of the valve.

In the case of the equalising type, the flapper may be provided with equalising means as disclosed in U.S. Pat. No. 4,415,036 (BAKER).

The flapper is preferably substantially planar in longitudinal cross-section.

The housing may be formed from a single, one piece, member.

The housing may provide a longitudinal recess in an inner wall thereof capable of receiving the flapper when the valve is in an open position.

The flapper may be hingeably mounted within the recess.

The means for controllable moving the flapper may comprise first biasing means for biasing the flapper into a first position wherein the valve is closed.

The means for controllably moving the flapper may further comprise a tube slideably moveable within the flow passage of the housing, the tube being moveable from a first position wherein the flapper is in the first position and the valve is closed to a second position wherein the flapper is in the second position and the valve is open.

The tube may be biassed into the first position by second biasing means.

The tube is preferably moveable from the first to the second position by means of applied hydraulic pressure.

According to a second aspect the present invention provides a well valve comprising a tubular housing, a valve closure member movable between open and closed positions and means for controlling movement of the valve closure member, wherein the movement control means includes at least one piston within/upon a wall of the housing and substantially longitudinally aligned thereof, wherein further at least one of the piston(s) is positioned in longitudinal relation to a portion of a surface of the wall of the housing and one of the piston or surface is provided with a protrusion which is received within a longitudinal groove provided in the other of the surface or the groove.

Provision of the protrusion and groove allows relative longitudinal movement between the piston and the housing while seeking to maintain rotational alignment therebetween.

The protrusion may be provided by a ball carried within a recess in the piston.

The valve may further comprise a tubular member telescopically movable longitudinally in the housing for controlling the movement of the valve closure member, means for biasing the tubular member in a first direction for causing the valve closure member to move to the closed position, and means for moving the tubular member in a second direction for opening the valve closure member comprising the at least one piston telescopically movable within and having its longitudinally axis within the wall of the housing outside the tubular member, the piston(s) contacting said tubular member, one side of the piston(s) being in communication with hydraulic fluid extending to the well surface for actuating the member in the second direction to open said valve closure member, the second side of the piston(s) being exposed to fluid pressure in the valve housing tending to move the piston(s) in the first direction and the piston(s) further having a cross-sectional width less than the thickness of the housing wall for reducing the hydrostatic force of the hydraulic fluid acting on the one side of the piston(s) whereby the valve may be used at a greater depths in the well.

BRIEF DESCRIPTION OF THE DRAWINGS

Embodiments of the present invention will now be described by way of example only, with reference to the accompanying drawings, which are.

DESCRIPTION OF DISCLOSED EMBODIMENTS

Figure 1A:
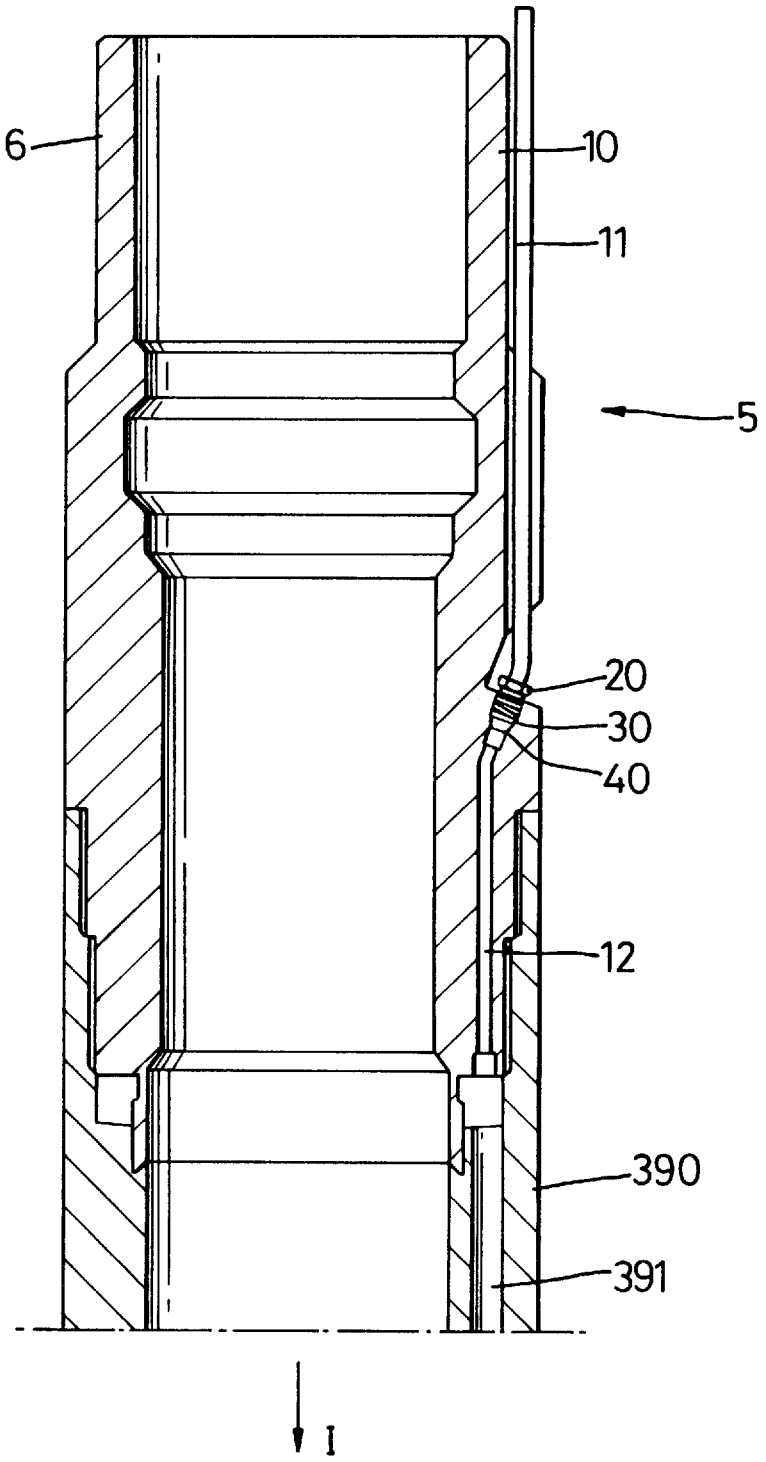
FIGS. 1(A), (B), (C) a cross-sectional side view of a first embodiment of a well valve according to the present invention.

Referring to FIGS. 1(A) to 4, there is illustrated a first embodiment of a subsurface well safety valve, generally designated 5, according to the present invention. The valve 5 comprises a first (pressure) housing 340 having a flow passage 345 provided therethrough. The valve 5 further comprises a flapper member 330 and means hereinafter described for controllably moving the flapper member 330 between first and second, respective open and closed positions, wherein the flapper member 330 is mounted upon a side wall of the housing.

The valve 5 provides first and second ends 6, 7, the first end 6 being closer to the surface, in use. Both ends 6, 7 provide means (for example, threaded portions) for attaching the ends 6, 7 to a length of production tubing. The valve 5 may therefore be inserted into a wellbore as part of a production tubing string, the valve 5 being positioned within the wellbore at a suitable depth.

The first end 6 comprises a top nipple 10 in the form of a hollow housing. A hydraulic control line 11 extending to the well surface is connected to a control passage 12 in the nipple 10 by means of a jam nut 20, back ferrule 30 and front ferrule 40.

A second end of the nipple 10 is connected to a first end of a second housing 390. The second housing 390 provides at least one hydraulic chamber 391, a first end of the hydraulic chamber 391 being communicable with the hydraulic line 11 via the hydraulic passage 12.

A second end of the second housing 390 is connected to a first end of a third housing 150, which housing 150 houses at least one piston 110 and a spring 200.

A second end of the hydraulic chamber 391 is coincident with a first end of a hydraulic housing 60, the first end of the hydraulic housing 60 having a further flow passage 61 so as to provide communication between the hydraulic chamber 391 and a chamber 62 provided within the hydraulic housing 60. The piston 110 is provided within the chamber 62 of the hydraulic housing 60, a first end of the piston 110 being provided with a seal retainer 70, MSE seal 80, seal mandrel 90 and wiper ring 100.

The second end of the hydraulic chamber 60 carries an end cap 120 through which a second end of the piston 110 protrudes. The second end of the piston 110 carries a piston extension 130 connected to a thrust ring 160 having a lock screw 180. The thrust ring 160 also provides on an outermost surface thereof a recess 169 capable of receiving a guide ball 170. The thrust ring 160 is threadably connected at a position A to a flow tube 210.

Figure 1B:
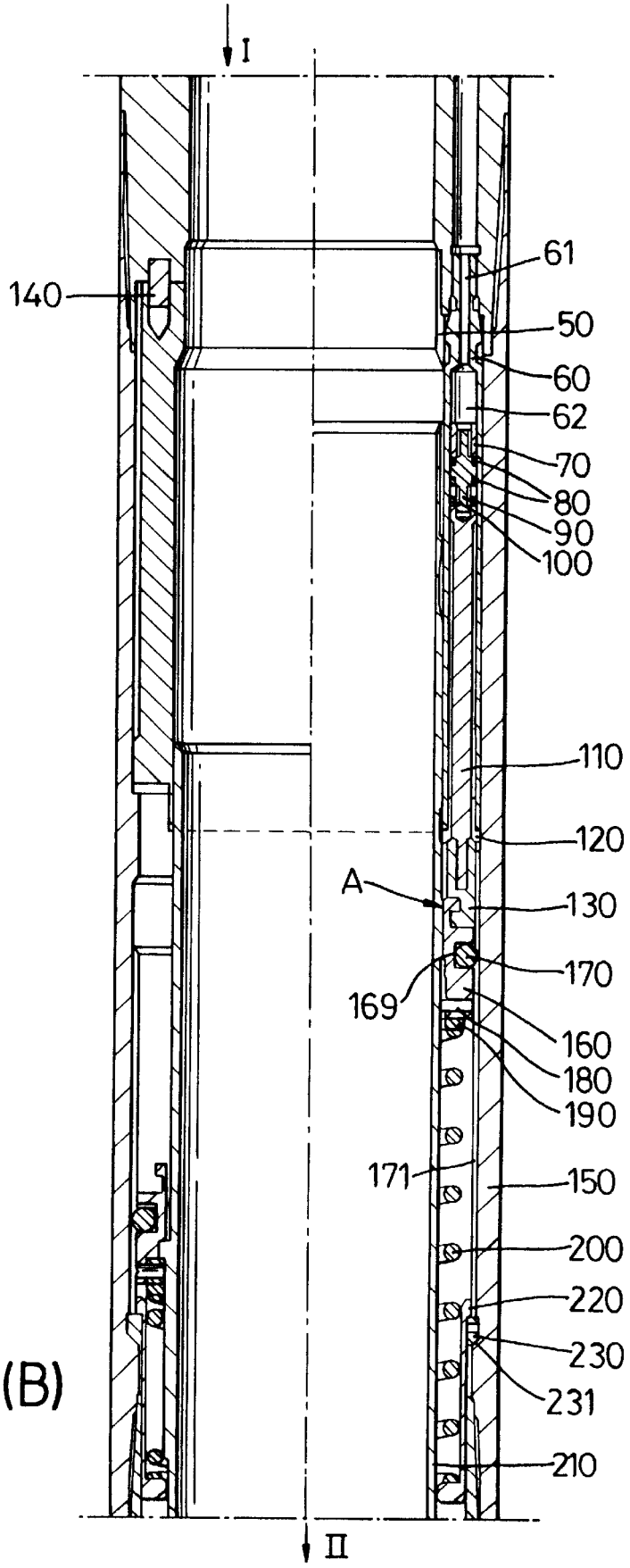

Referring to FIG. 1(B), a groove 171 is shown in the wall of housing 150 in which ball 170 locates and can only travel axially. The purpose of this feature is to prevent the torque generated by compressing coil spring 200 (during opening) from skewing the piston 110 off to one side.

Between the second end of the second housing 390 and the hydraulic housing 60 there is provided an anti-rotation dowel, and a guide 50.

Between the third housing 150 and the flow tube 210 there is provided the (power) spring 200.

A first end of the spring 200 abuts an end of the thrust ring 160 via a spring washer 190. A second end of the spring 200 is in abutting contact with a spring stop member 220 which stop member 220 is retained between the third housing 150 and the flow tube 210 by means of a o-ring 230 retained within the third housing by means of a lip 231.

A second end of the third housing 150 is connected to a first end of the first housing 340.

Within the first housing 340 there is provided, at first end thereof, a compression unit 240, a flow tube guide 250, a soft metal seat 260 and a flapper hard seat 270, as well as an adjustment spacer 280 and a flapper soft seat 290.

The flapper member 330 is hingeably connected to the housing 340 and biased into a first closed position against the flapper soft seat 290 by means of a flapper pin 300, flapper sleeve 310, flapper spring 320, seal nut 370 and metal seal 380. As can be seen from FIG. 2, the flapper pin 300 is inserted through the flapper member 330 from the exterior of the first housing 340, and is capped by the metal seal 380 and the seal nut 370. As will be readily appreciated by those of skill in the art from FIGS. 2 and 4, the flapper pin 300 is pressure sealed, once installed, by the seal nut 370 and metal seal 380, thus maintaining the pressure integrity of the first housing 340.

Figure 4:
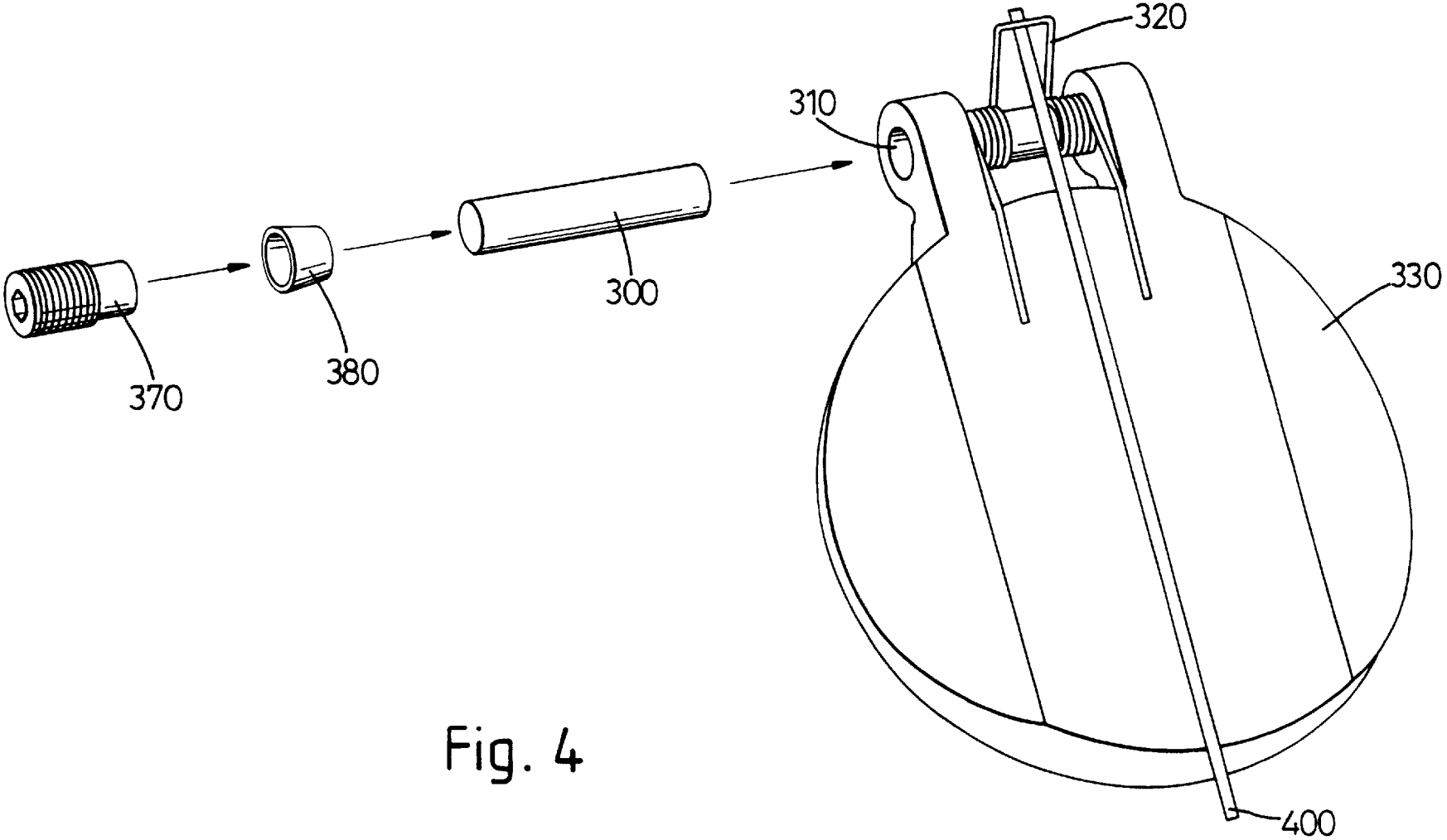
FIG. 4 a perspective view of a flapper member and associated parts for use in the valve of FIG. 1.

The flapper 330 and flapper spring 320 may be located within the housing 340 employing an assembly tool 400, as shown in FIG. 4.

Figure 1C:
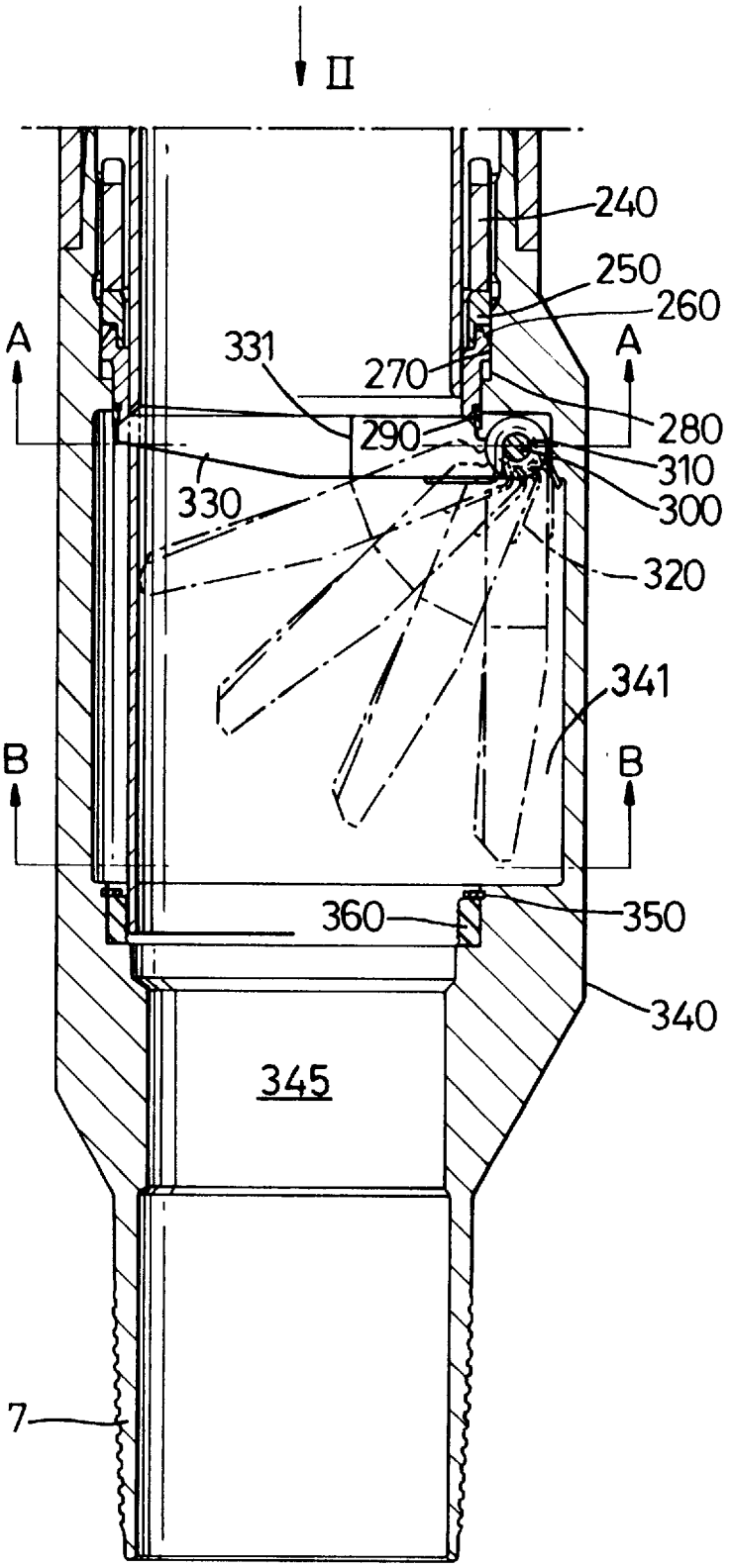
Figure 2:
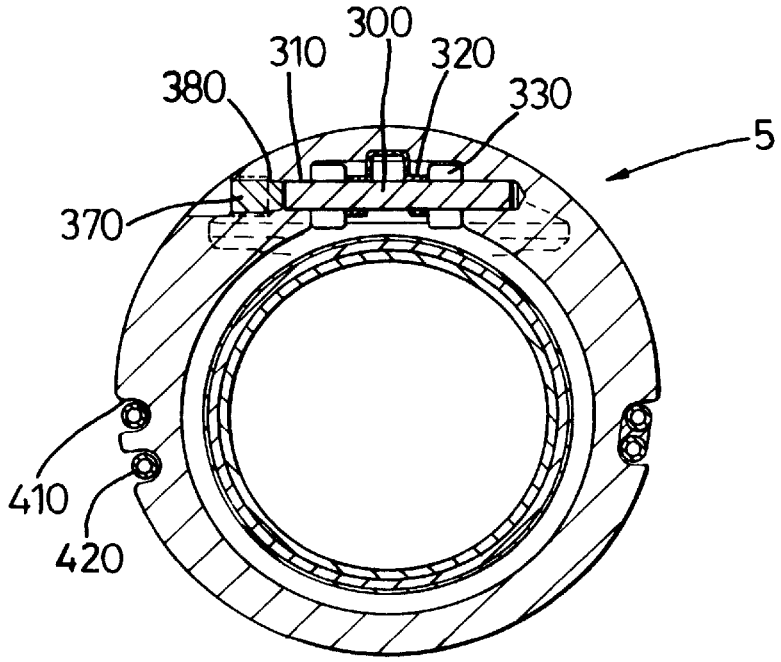
FIG. 2 a cross-sectional view along line 2—2 of the valve of FIG. 1(C)
Figure 3:
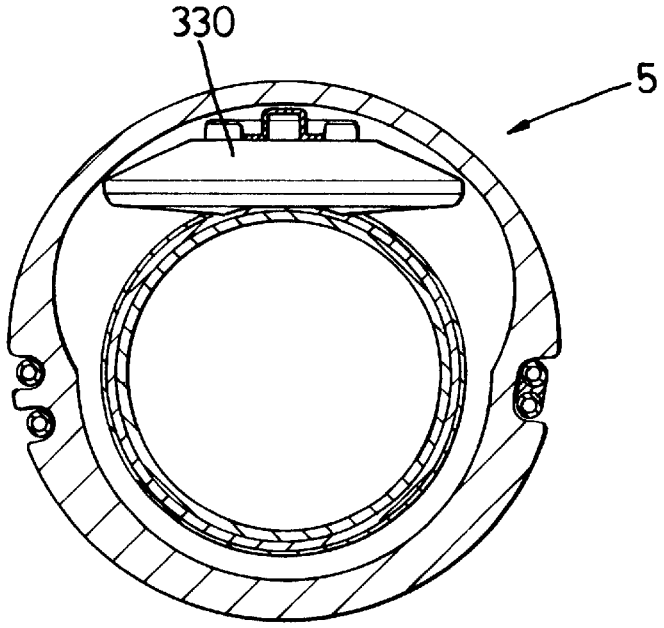
FIG. 3 a cross-sectional view along line 3—3 of the valve of FIG. 1(C)

As can be seen clearly from FIG. 1(C) the first housing 340 is provided with a longitudinally recess 341 in an inner wall thereof capable of receiving the flapper member 330 when the valve 10 is in an open position.

In an inner surface of the housing 340 there is also provided a circlip 350 and a wiper seal 360.

In this embodiment the flapper 330 carries pressure equalising means 331, for automatically equalising the pressure across the closed flapper member 330 during the opening sequence of the valve 10.

On an outermost surface of the valve 5 there are provided a number of recesses 410 capable of receiving hydraulic lines 240, which lines may be used to control tools further in the wellbore.

The operation of the valve will now be described. Referring to FIGS. 1(A), (B) and (C), the right hand side of the figure illustrates the position of the spring 200 when the valve 5 is in a normally closed position with the flapper member 330 biased by the flapper spring 320 against the flapper soft seat 290. The left hand side of FIGS. 1(A), (B) and (C) illustrates the position of the spring 200 when a hydraulic pressure signal is applied to the hydraulic line 11 thereby actuating the valve 5 and causing the flapper member 330 to move to its second position within the recess 341 thereby allowing production flow through the flow tube 210.

With no hydraulic pressure signal applied to the hydraulic line 11, the piston 110 is biased by the spring 200 into a first position as illustrated on the right hand side of FIG. 1(B). The flow tube 210 is, therefore, also in a first position remote from the flapper member 330. The flapper member 330 is, therefore, biased into first position by the flapper spring 320.

Upon application of a hydraulic pressure signal within line 11, piston 110 will seek to move to a second position within the hydraulic housing 60 against the biasing force of the spring 200. A second end of the flow tube 210 will, therefore, be caused to contact the flapper member 330 thereby moving the flapper member 330 from its first position. If the applied hydraulic pressure signal is sufficient then the piston 110 will be caused to move to its second position against the driving force of the spring 200, thereby causing the second end of the flow tube 210 to move to a position as shown on the right hand side of FIG. 1(C) wherein the second end of the flow tube 210 is in contact with the wiper seal 360. In this position the flow tube 210 closes the recess 341 trapping the flapper member 330 therein.

Upon release of the applied hydraulic pressure signal the piston 110 will relax to its first position under the biasing force of the spring 200 thereby causing the flow tube 210 to return to its first position. The flapper member 330 will therefore be caused to return to its first position under the biasing force of the flapper spring 320.

Referring to FIGS. 5(A) through 9, there is illustrated a second embodiment of a subsurface well safety valve, generally designated 5', according to the present invention. The valve 5' is similar to the valve 5 of the first embodiment, like parts being identified by like numerals with a "'".

The valve 5' further comprises the following parts:

back-up ring 405';
t-seal 406';
lee installation pin 407';
connecting rod 413';
seat stop 414';
piston up stop 415';
wiper ring 416';
spring housing 417';
piston thrust ring 418';
clutch plate 419';
spring stop ring 420';
wave spring 421';
upper split ring retainer 432';
split ring 423'
lower split ring retainer 424';
spring spacer 425';
spring retainer 428';
split ring 429';
compression nut 430';
seat seal ring 431';
metal plug 440';
metal plug seal 441';
poppet (not shown);
left spring (not shown);
button hd. soc. cap. screw 444'.

Figure 5A:
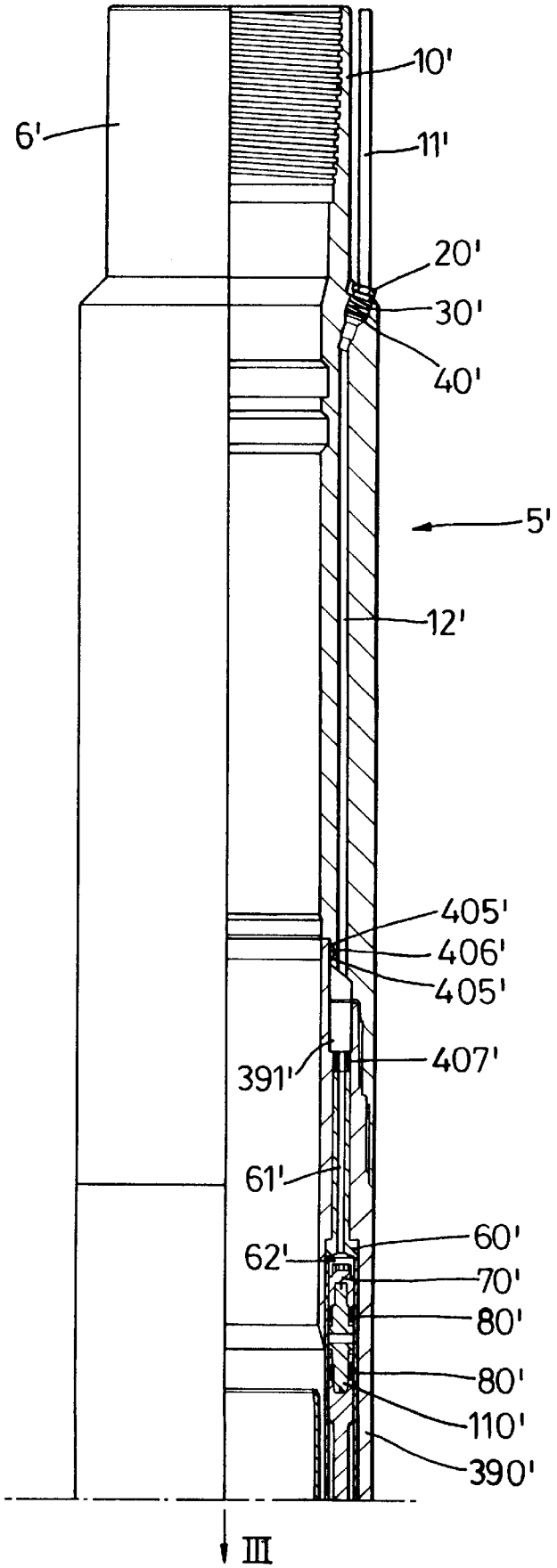
FIGS. 5(A), (B), (C) a cross-sectional side view of a second embodiment of a well valve according to the present invention, in a closed position.
Figure 5B:
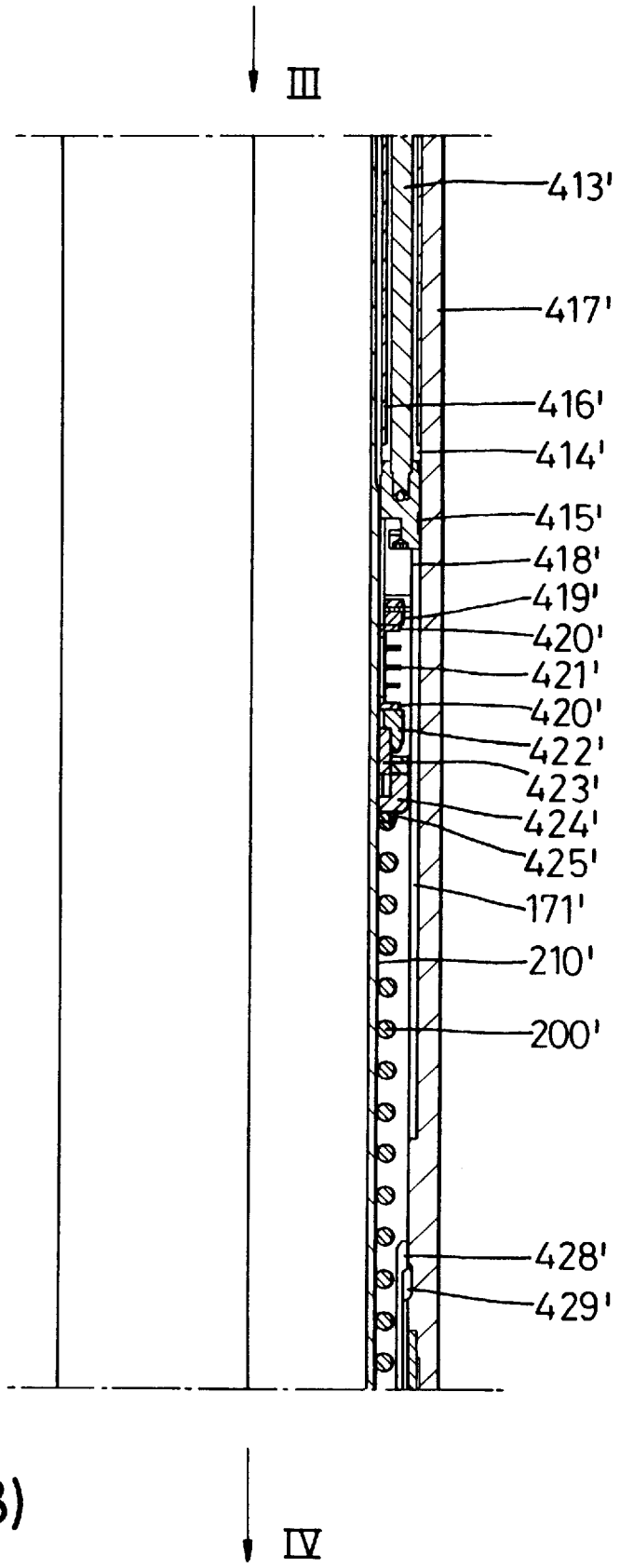
Figure 5C:
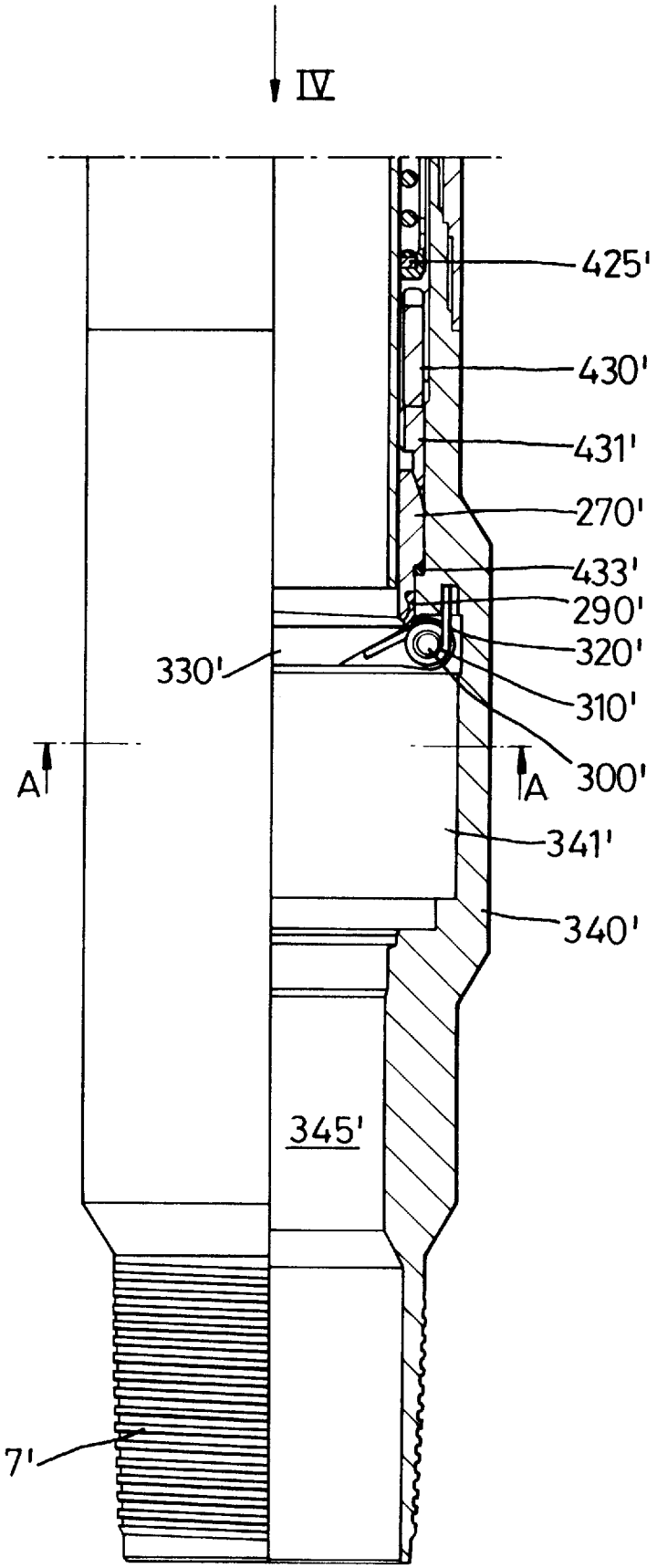
Figure 6A:
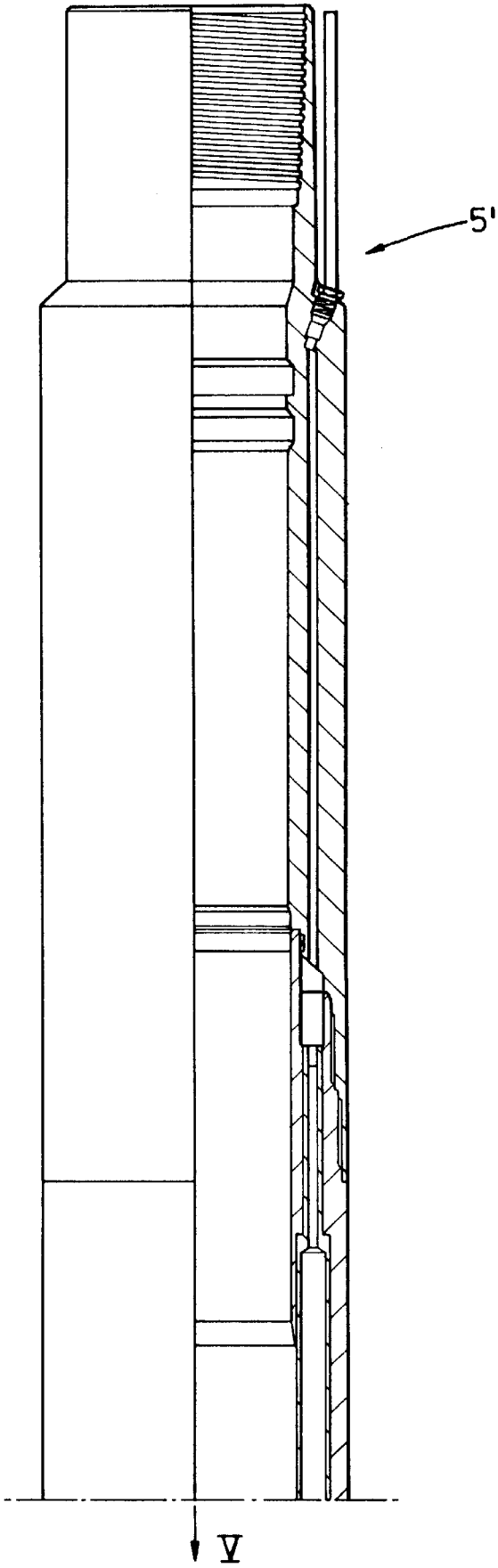
FIGS. 6(A), (B), (C) a cross-sectional side view of the valve of FIGS. 5(A), (B), (C) in an open position.
Figure 6B:
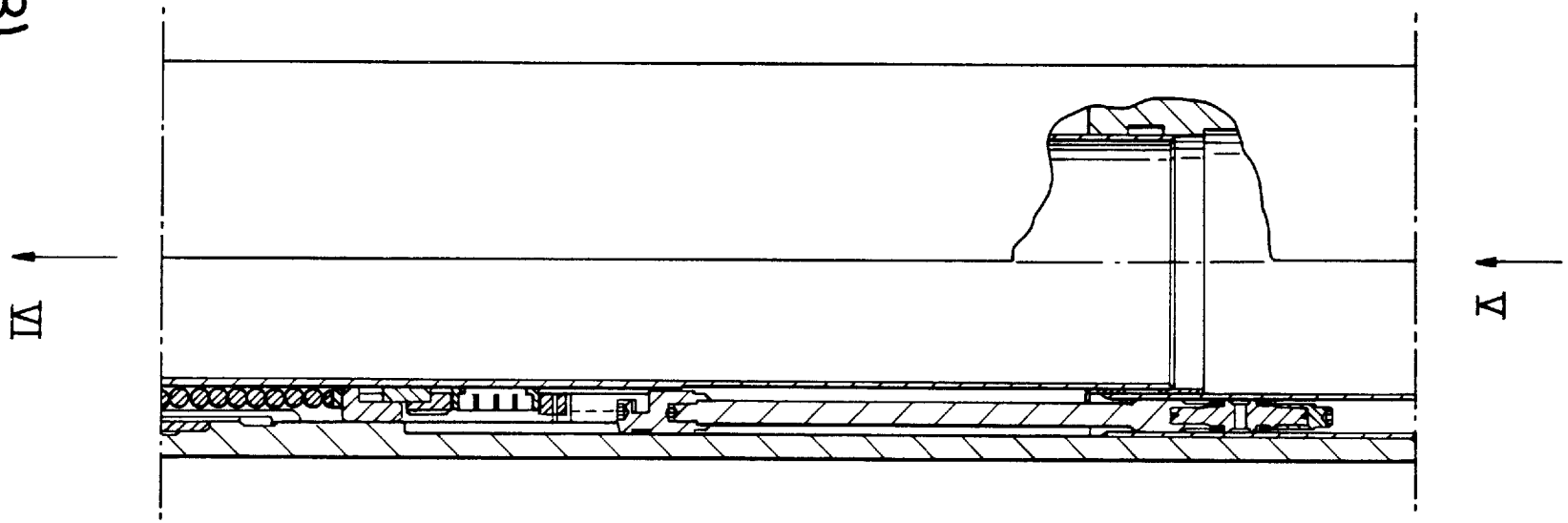
Figure 6C:
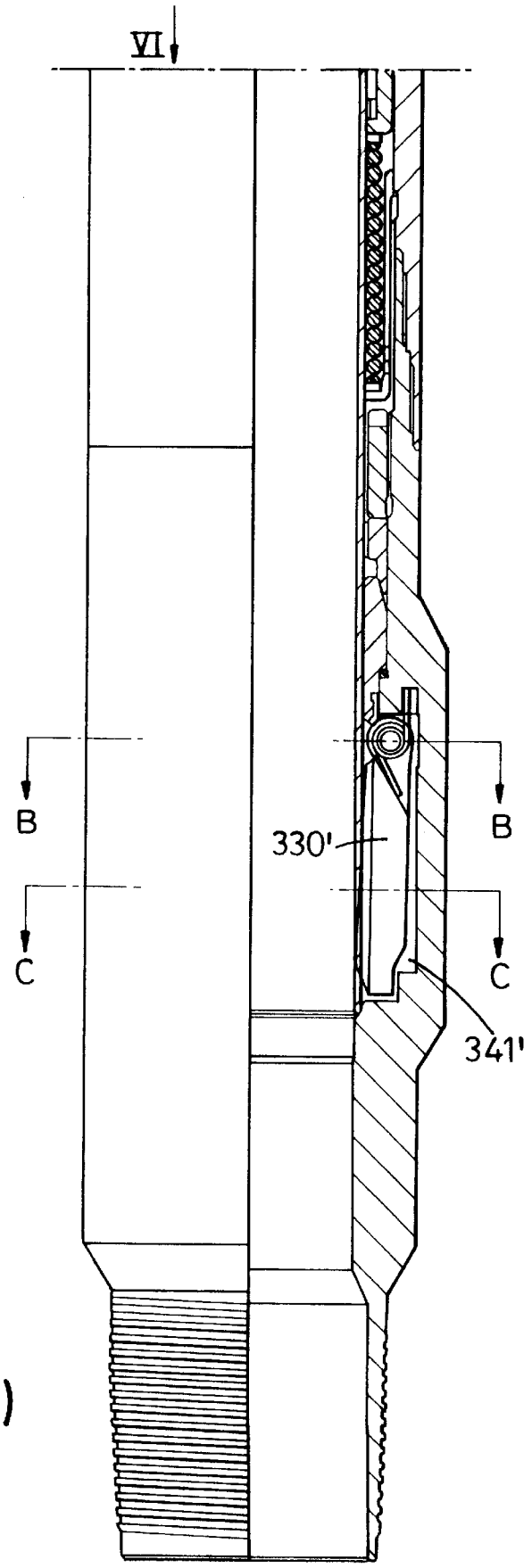
Figure 7:
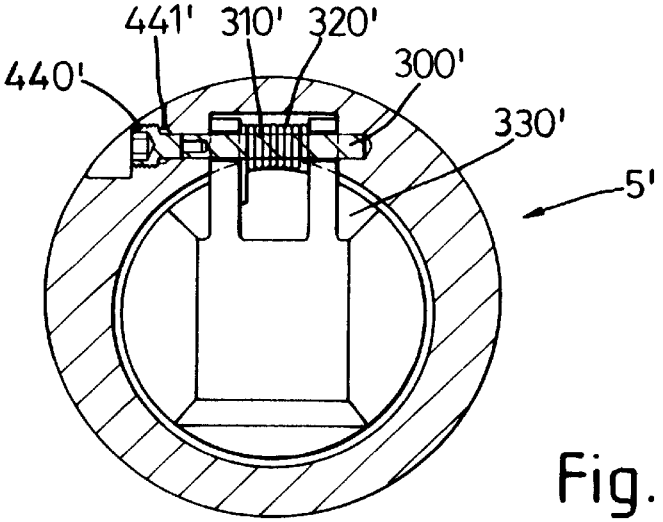
FIG. 7 a cross-sectional view along line 7—7 of the valve of FIG. 5(C)
Figure 8:
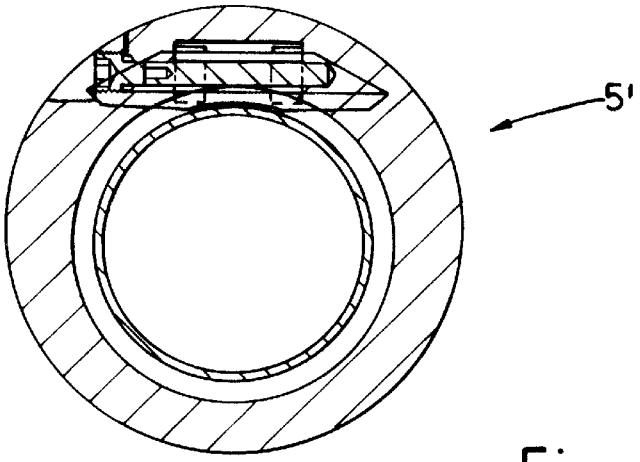
FIG. 8 a cross-sectional view along line 8—8 of the valve of FIG. 6(C)
Figure 9:
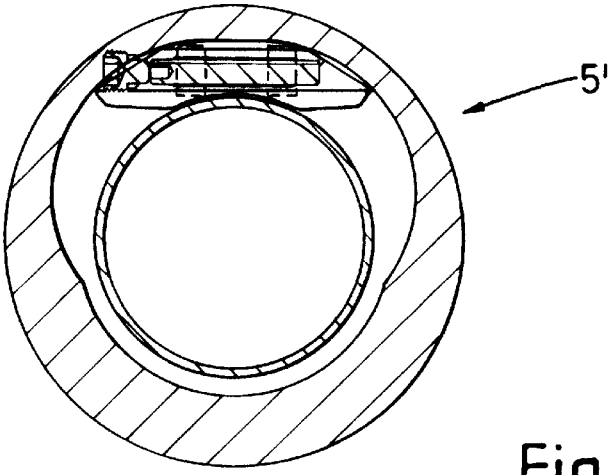
FIG. 9 a cross-sectional view along line 9—9 of the valve of FIG. 6(C).

As in the first embodiment, and as shown in FIGS. 5(C) and 7, the flapper member 330' of the second embodiment is hingeably connected to the housing 340' and biased into a first closed position against the flapper soft seal 290' by means of a flapper pin 300', flapper sleeve 310', flapper spring 320', metal plug 440', and metal plug seal 441'. Also as in the first embodiment and as can be seen from FIG. 7, the flapper pin 300' is inserted through the flapper member 330' from the exterior of the first housing 340', and is capped by the metal plug 440' the metal plug seal 441'. As will be readily appreciated by those of skill in the art from FIGS. 5(C) and 7, the flapper pin 300' is pressure sealed, once installed, by the metal plug 440' and the metal plug seal 441', thus maintaining the pressure integrity of the first housing 340'.

The valve 5' is of the non-equalising type, wherein external means is provided for balancing pressure across the closed flapper member 330' prior to opening of the valve 5'.

The valve 5' employs an alternative method of installing the hydraulic actuator assembly into the body of the valve 5'. Once again a groove 171' in the wall of the housing 150' is used to guide the end of the actuator, ie piston 110' in the axial direction. The use of a groove 171, 171' by either of the methods shown or other possible alternative using a groove, are an improvement over existing rod piston type actuated safety valves. For example, as shown in GB Patent No 2 018 332 or No 2 199 604.

The embodiments of the invention hereinbefore described are given by way of example only, and are not meant to limit the scope of the invention in any way.

It should be particularly appreciated that one aspect of the present invention provides advantage over the prior art by providing a greater internal bore than can be provided by conventional flapper valves.

I claim:

1. A tube-mounted subsurface safety valve comprising:

a pressure housing having a flow passage provided therethrough and an exterior;

a flapper member having first and second, respectively open and closed positions, the flapper member being mounted to the housing in the flow passage, and the flapper member in the closed position acting against the pressure housing to effect closure of the valve and in the open position permitting flow through the flow path;

a hinge pin mounting the flapper member to the housing, the hinge pin being installed and sealed from said exterior of the pressure housing; and means for controllably moving the flapper member between the first and second positions.

2. A subsurface valve as claimed in claim 1, wherein the valve is of the non-equalising type, wherein external means is provided for balancing pressure across the closed flapper prior to opening of the valve.

3. A subsurface valve as claimed in claim 1, wherein the valve is of the self-equalising type, wherein pressure across the closed flapper is equalised automatically during the opening sequence of the valve.

4. A subsurface valve as claimed in claim 3, wherein the flapper is provided with pressure equalising means for equalising pressure across the closed flapper.

5. A subsurface valve as claimed in claim 1, wherein the flapper is substantially planar in longitudinal cross-section.

6. A subsurface valve as claimed in claim 1, wherein the housing is formed from a single, one piece, member.

7. A subsurface valve as claim in claim 1, wherein the housing has an inner wall, and the housing provides a longitudinal recess in the inner wall thereof capable of receiving the flapper member when the valve is in an open position.

8. A subsurface valve as claimed in claim 7, wherein the flapper is hingeably mounted within the recess.

9. A subsurface valve as claimed in claim 1, wherein the means for controllably moving the flapper comprises first biasing means for biasing the flapper into the first position wherein the valve is closed.

10. A subsurface valve as claimed in claim 1, wherein the means for controllably moving the flapper further comprises a tube slideably moveable within the flow passage of the housing, the tube being moveable from a first position wherein the flapper is in the first position and the valve is closed to a second position wherein the flapper is in the second position and the valve is open.

11. A subsurface valve as claimed in claim 10, wherein the tube is biassed into the first position by biasing means.

12. A subsurface valve as claimed in claim 10, wherein the tube is moveable from the first to the second position by means of applied hydraulic pressure.

13. A well valve comprising:

a tubular housing including a single, one piece member forming a pressure housing, the pressure housing having flow passage provided therethrough and an exterior;

a valve closure member movable between open and closed positions, the valve closure member being mounted to the pressure housing in the flow passage, and the valve closure member in its closed position acting against the pressure housing to effect closure of the valve, and in the open position permitting flow through the flow path;

a hinge pin mounting the valve closure member to the pressure housing, the hinge pin being installed and sealed from the exterior of the pressure housing; and control means for controlling movement of the valve closure member, the control means including at least one piston substantially longitudinally aligned with the wall, the at least one piston being positioned in longitudinal relation to a portion of a surface of the wall, the surface of the wall being provided with a longitudinal groove and the at least one piston being provided with a protrusion which is receive within the longitudinal groove.

14. A well valve as claimed in claim 13, wherein the valve further comprises:

a tubular member telescopically movable longitudinally in the housing for controlling the movement of the valve closure member; and biasing means for biasing the tubular member in a first direction for causing the valve closure member to move to the closed position; and wherein the at least one piston defines moving means for moving the tubular member in a second direction for opening the valve closure member, the at least one piston having a longitudinal axis within the wall of the tubular housing and first and second sides, the at least one piston contacting the tubular member, the first side of the at least one piston being in communication with hydraulic fluid extending to the well surface for actuating the tubular member in the second direction to open the valve closure member, the second side of the at least one piston being exposed to fluid pressure in the valve housing tending to move the at least one piston in the first direction, and the at least one piston further having a cross-sectional width less than the thickness of the wall of the tubular housing for reducing the hydrostatic force of the hydraulic fluid acting on the first side of the at least one piston whereby the valve can be used at a greater depth in the well.

* * * * *